US006536635B1

(12) United States Patent
Garcia et al.

(10) Patent No.: US 6,536,635 B1
(45) Date of Patent: Mar. 25, 2003

(54) CONTAINER FOR FLUID PRODUCT SAMPLE DESIGNED TO BE PRESSED

(75) Inventors: Firmin Garcia, Evreux (FR); Aline Abergel, Boulogne-Billancourt (FR)

(73) Assignee: Valois S.A., Neubourg (FR)

( * ) Notice: Subject to any disclaimer, the term of this patent is extended or adjusted under 35 U.S.C. 154(b) by 0 days.

(21) Appl. No.: 09/937,814

(22) Filed: Jan. 16, 2002

(30) Foreign Application Priority Data

Apr. 2, 1999 (FR) ..... 99 04503

(51) Int. Cl.[7] ..... B05B 11/06

(52) U.S. Cl. ..... 222/633; 222/212; 222/215; 239/327

(58) Field of Search ..... 227/632, 633, 227/209, 212, 215; 239/327, 328

(56) References Cited

U.S. PATENT DOCUMENTS

| | | | | | |
|---|---|---|---|---|---|
| 465,484 | A | * | 12/1891 | Magoris | 222/633 |
| 467,647 | A | * | 1/1892 | Somers | 222/215 |
| 1,438,487 | A | * | 12/1922 | Green | 222/215 |
| 1,617,545 | A | * | 2/1927 | Salpas | 222/212 |
| 2,432,288 | A | * | 12/1947 | Danziger | 222/215 |
| 2,788,921 | A | | 4/1957 | Galinas | |
| 3,174,655 | A | * | 3/1965 | Hurschman | 222/215 |
| 3,897,005 | A | * | 7/1975 | Reiner | 239/327 |
| 4,044,836 | A | * | 8/1977 | Martin et al. | 222/215 |
| 4,787,536 | A | * | 11/1988 | Widerstrom | 222/212 |
| 5,979,710 | A | * | 11/1999 | Willemsen et al. | 222/215 |

FOREIGN PATENT DOCUMENTS

| | | | | |
|---|---|---|---|---|
| FR | 2 778 639 A | | 11/1999 | |
| GB | 626631 A | | 11/1945 | |
| WO | WO 99/59881 A | * | 11/1999 | B65D/1/32 |

* cited by examiner

*Primary Examiner*—Kenneth Bomberg
(74) *Attorney, Agent, or Firm*—Sughrue Mion, PLLC

(57) ABSTRACT

A dispenser for dispensing a fluid, said dispenser comprising: a reservoir (3) containing said fluid and provided with at least one actuating wall (10) on which pressure is exerted to reduce the volume of the reservoir, said reservoir being provided with resilient means (4) suitable for increasing the volume of the reservoir; a dispensing orifice (50) via which the fluid is dispensed as a mixture with a gas, so as to generate a two-phase spray; and a removable closure element (12) for closing the dispensing orifice (50), thereby isolating the reservoir from the outside; said dispenser being characterized in that the resilient means are stressed so that the reservoir defines a minimum volume so long as the closure element (12) closes off the dispensing orifice.

15 Claims, 3 Drawing Sheets

CONTAINER FOR FLUID PRODUCT SAMPLE DESIGNED TO BE PRESSED

The present invention relates to a dispenser for dispensing a fluid, and more particularly a fluid sample for insertion in a magazine, or some other publication for promotional purposes. The use of a dispenser of the invention is naturally not limited to this use alone, but it does constitute a preferred application for the invention. Therefore, the fluid sample of the invention relates particularly to the fields of perfumes and of cosmetics, for which magazines constitute a major promotional medium.

Since this type of dispenser is made available free of charge, its cost must be particularly low. The component parts of the dispenser and dispenser assembly must be very inexpensive. One known type of sample dispenser has a reservoir containing the fluid and provided with at least one actuating wall on which pressure is exerted, e.g. by means of the thumb, so as to reduce the volume of the reservoir. In addition, the sample is provided with a dispensing orifice via which the fluid is dispensed when the actuating wall is pressed. To improve the quality of the jet of fluid dispensed, it is known that a two-phase spray can be implemented in the form of a mixture of air and of fluid. For this purpose, the reservoir must contain both the fluid and the gas (in general, air). Thus, when the actuating wall is pressed, the fluid is dispensed together with the air, thereby generating a two-phase spray. In addition, that type of sample dispenser is often provided with a removable closure element, e.g. in the form of a tear-off or fold-back tab, for closing off the dispensing orifice, thereby isolating the reservoir from the outside prior to use.

Of the prior art, mention may be made, for example, of Document U.S. Pat. No. 3,897,005 which describes packaging made up of two shells bonded together to define an inside volume which serves as a reservoir. That reservoir is filled with a fluid and with air. In that portion of the reservoir in which the fluid is stored, there is a resilient element (a sort of foam) which locally spaces the two shells apart, even in the state in which it is not yet in use. To actuate that packaging, a corner is torn off, and the shells are pressed together over the resilient element.

When such a sample dispenser is to be inserted inside press publications, e.g. magazines, it is subjected to high pressure due to the weight of the magazines since, in general, they are stored by being stacked up. Thus, the samples situated lowest down are subjected to a pressure corresponding to the total weight of the stack of magazines. Since their reservoirs are filled both with air and with fluid, and since the resilient element can be flattened, there is an obvious risk of a reservoir bursting.

One of the problems addressed by the present invention is thus the ability of the dispenser to withstand pressure.

Another problem addressed by the present invention is to provide a dispenser that is of very small thickness, in particular in its storage condition.

Another problem for the present invention is to provide a dispenser whose actuating wall offers resilience and a return force that are sufficient for it to be actuated by means of a finger, e.g. the thumb.

To this end, the present invention provides a dispenser for dispensing a fluid, said dispenser comprising:

a reservoir containing said fluid and provided with at least one actuating wall on which pressure is exerted to reduce the volume of the reservoir, said reservoir being provided with resilient means suitable for increasing the volume of the reservoir;

a dispensing orifice via which the fluid is dispensed as a mixture with a gas, so as to generate a two-phase spray; and a removable closure element for closing the dispensing orifice, thereby isolating the reservoir from the outside;

the resilient means being stressed so that the reservoir defines a minimum volume so long as the closure element closes off the dispensing orifice. Thus, the resilient means are not at rest, but rather they store potential energy because they are subjected to stress, usually exerted in the form of deformation.

Thus, prior to removing the closure element, the dispenser is in a configuration that is particularly flat because of the atmospheric pressure that is exerted on the walls of the reservoir so as to flatten it. As soon as the closure element is removed, air can penetrate into the reservoir which is then brought to ambient pressure, thereby enabling the resilient means to relax to a rest position, in which said reservoir defines a maximum volume.

In a first embodiment, the resilient means are defined by the actuating wall which has shape memory enabling it to return to a rest state in which the reservoir defines a maximum volume. In which case, the resilient properties of the actuating wall are used directly. To enable repeated actuating, the actuating wall must have a certain amount of instantaneous shape memory. To enable it to perform the function of resilient means of the invention, it must also have long-term shape memory, since sample dispensers included in magazines can be stored for long periods. That is why the wall must have long-lasting shape memory. The thickness of the dispenser is then determined directly by the thickness of the actuating wall in the fully pushed-in or fully flattened state. As soon as the closure element is removed, the actuating wall returns to its natural state, in which it is possible to actuate it by pushing it in.

In a second embodiment, the resilient means comprise a resilient element disposed inside the reservoir. Advantageously, the resilient element acts on the actuating wall. In which case, the resilient element is an additional part so that the actuating wall does not need to have particular shape-memory capacities.

In addition since the resilient element is stressed to its minimum volume, it is the resilient element that determines the thickness of the dispenser by its own thickness in the fully-compressed state. Thus, the pressure exerted, for example, by a stack of magazines on the walls of the reservoir is not exerted on the fluid inside the reservoir, but rather on the resilient element in its maximally-compressed state. Thus, any risk of the reservoir bursting due to the applied pressure is eliminated because the liquid itself is subjected to almost no pressure. In its fully-compressed configuration, the resilient element then acts as a spacer between the walls of the reservoir so as to define a volume in which the fluid is subjected to almost no pressure. When in the relaxed state, the resilient element is the part with the greatest thickness, and if a sample were to be put in a magazine in this state, it would either be too thick or else it would burst. When it is flattened, it is quite fine. In contrast, as soon as the closure element is removed, air (or more generally gas) can penetrate into the reservoir via the dispensing orifice, so that the resilient element can relax so as to increase the inside volume of the reservoir. It can be said that the reservoir contains almost no fluid so long as the closure element closes off the dispensing orifice. And by filling the dispenser under a vacuum or in an inert atmosphere, it is guaranteed that the fluid stored in the reservoir has never been in contact with the air, thereby protecting it from any damage, e.g. by oxidation.

The dispenser becomes a two-phase spray only after the closure element has been removed, thereby enabling air to enter the reservoir. The dispenser can then be used to release a jet of finely-divided fluid. In addition, the resilient element imparts a certain amount of resilience to the actuating wall that it could not procure by itself. The spring thus performs a function of resisting finger pressure, at the same time as performing a return spring function so as to return the dispenser to its extended initial position.

In a first variant, the resilient element is in the form of a conical spiral spring suitable for being flattened to the thickness of one turn. With a conical spiral spring, it is possible to bring all of the turns into the same plane so that, in the compressed state, the spring is of thickness corresponding to the thickness of a single turn. In the reservoir of the dispenser, the spring then makes it possible to define a volume in which the fluid is not subjected to any pressure.

In a second variant, the resilient element is in the form of a molded plastics part including resilient cross-braces between which a hinged assembly extends that is suitable for being stressed into the same plane as the cross-braces. Preferably, the assembly comprises two legs each connected in hinged manner via one of its ends to a respective one of the resilient cross-braces, and via its other end to a small table-top, so that the table-top can be brought into the same plane as the cross-braces and the legs. This is a second version that is made entirely of plastic, which offers advantages as regards its capacity to be recycled.

The present invention is described more fully below with reference to the accompanying drawings which give an embodiment of the present invention by way of non-limiting example.

Figure 1:
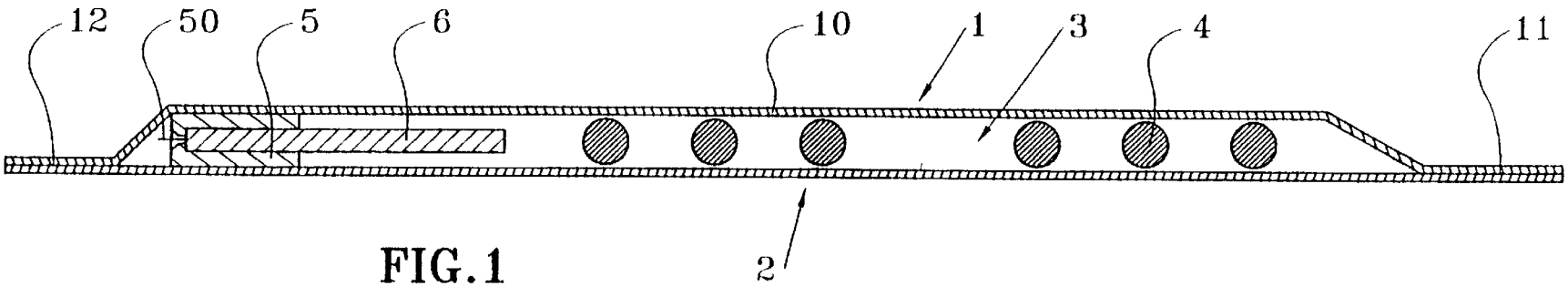
FIG. 1 is a vertical cross-section view through a dispenser of the invention, in the storage state in which it is not yet in use.
Figure 2:
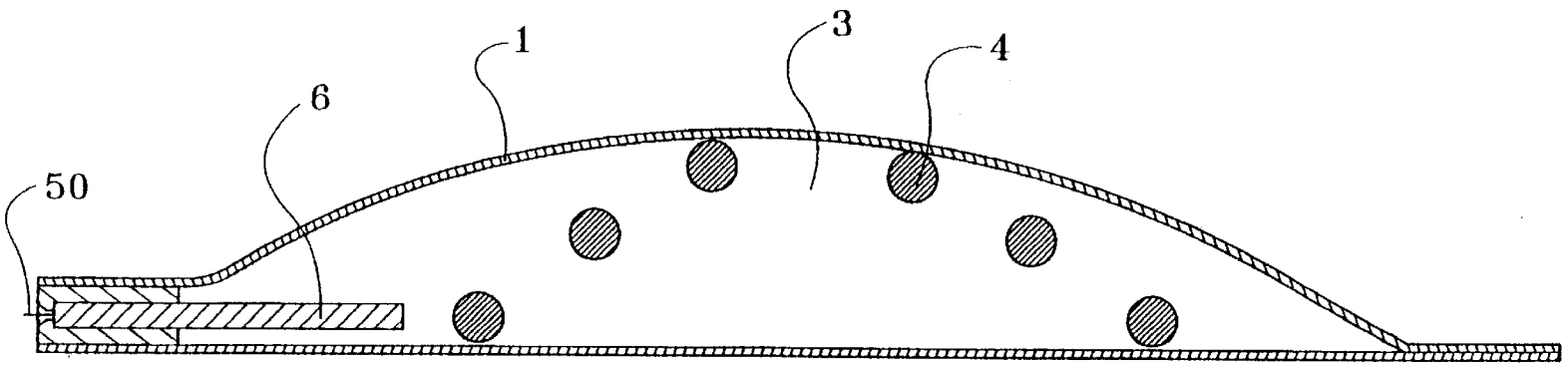
FIG. 2 is a view of the dispenser of FIG. 1 in the in-use state.
Figure 3:
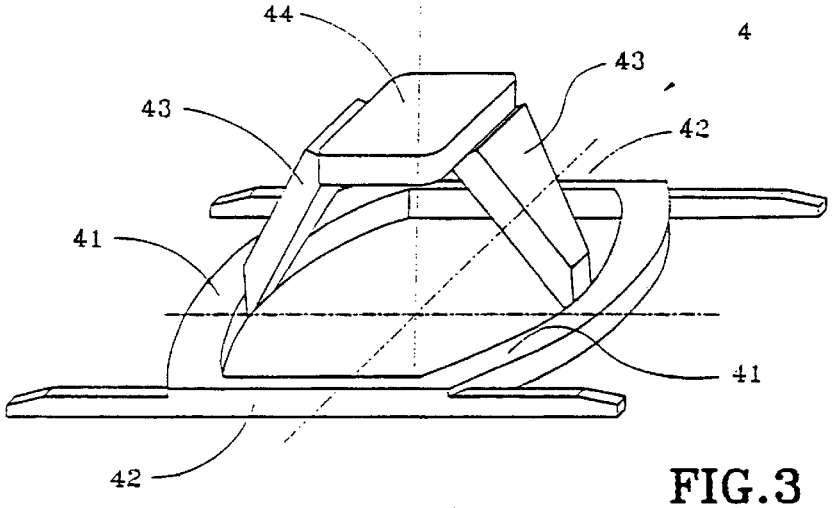
FIG. 3 is a perspective view of a resilient element that can be used in a dispenser of the invention.
Figure 6A:
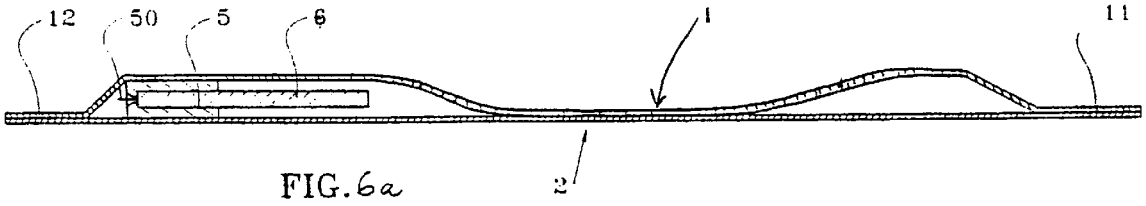
Figure 6B:
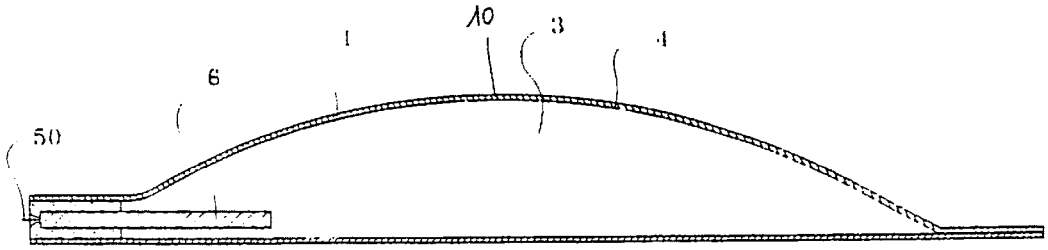
Figure 5A:
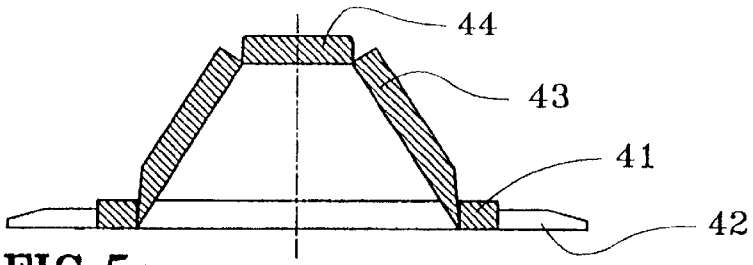
Figure 5B:
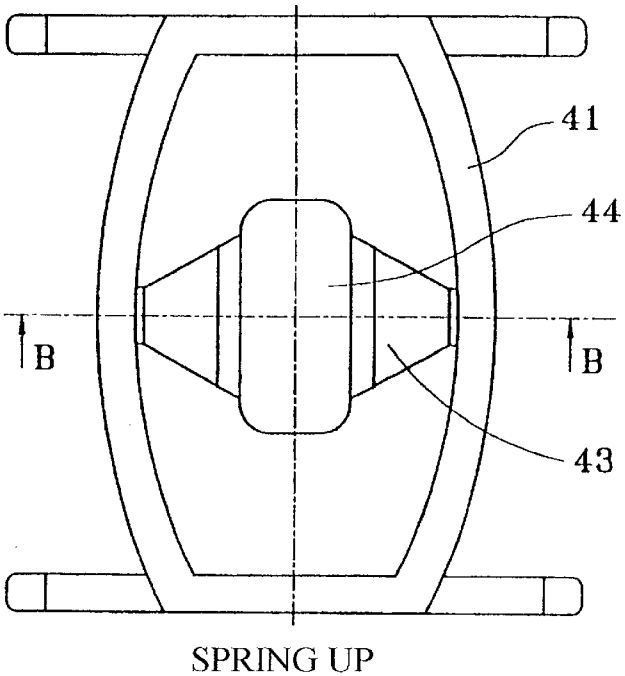
Figure 4A:
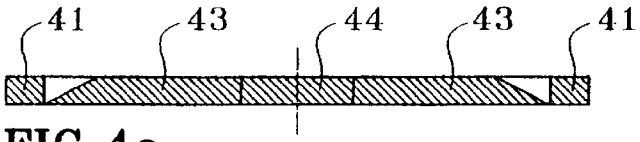
Figure 4B:
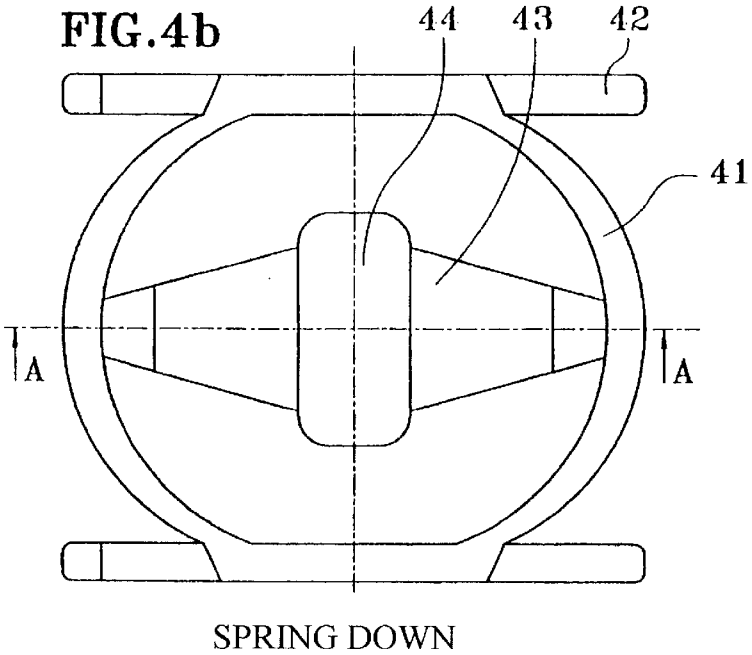

FIGS. 4*a* and 4*b* are views respectively in section and in plan showing the resilient element of FIG. 3 in the fully compressed state;

FIGS. 5*a* and 5*b* are views similar to the views of FIGS. 4*a* and 4*b,* in the fully relaxed state; and FIGS. 6*a* and 6*b* are views similar to the views of FIGS. 1 and 2, showing a second embodiment.

In the non-limiting embodiments used to illustrate the present invention, the dispenser may be made up of two sheets of flexible composite film 1 and 2 which are bonded together over their entire peripheries 11, 12 so as to define between them a volume that corresponds substantially to the volume of a fluid reservoir 3. An insert 5 may also be disposed between the two sheets 1 and 2. This insert 5 defines a dispensing orifice 50 and a recess in which a porous fiber 6 may be received so as to extend inside the reservoir 3. This fiber 6 serves to become imbibed with fluid contained in the reservoir 3. Once the fiber is imbibed with fluid, it is necessary merely to cause a flow of air to pass through the fiber to cause two-phase dispensing to take place at the dispensing orifice 50 in the insert 5. In front of the dispensing orifice 50, the two sheets 1 and 2 as bonded together define a tear-off or fold-back tab 12 which closes off the dispensing orifice 50 so as to isolate the reservoir 3 from the outside.

In the embodiment shown in FIGS. 1 and 2, the reservoir 3 contains a resilient element 4 which is disposed between the two sheets 1 and 2. As shown in FIG. 2, this resilient element 4 acts on at least one wall 1 of the dispenser, which wall may be the actuating wall, so as to increase the inside volume of the reservoir 3. According to a particularly advantageous characteristic of the invention, the resilient element 4 is stressed into its fully-compressed state so long as the closure element 12 closes off the dispensing orifice 50 and isolates the reservoir 3 from the outside. In other words, the reservoir 3 is sealed at manufacture with the resilient element stressed in its maximally-compressed state so that the reservoir then has its minimum volume. In this state, as shown in FIG. 1, the reservoir 1 contains fluid almost exclusively and almost no gas or no gas at all. Since the reservoir 3 is totally isolated from the outside by the closure element 12, the resilient element 4 cannot relax inside the reservoir 3 because of the atmospheric pressure that is exerted on the walls 1 and 2 of the reservoir. The dispenser can then be stored in this state prior to being used. In this state, it has particularly small thickness which is defined substantially by the thickness of the resilient element 4 in its fully-compressed state plus the total thickness of the two sheets of film 1 and 2. The resilient element 4 then determines a minimum volume for the reservoir in which the fluid is stored substantially without being subjected to any pressure. Thus, there is no risk of the reservoir 3 leaking by being flattened. Such a dispenser may, for example, be inserted between the pages of a magazine because it is particularly flat and particularly pressure-resistant.

As soon as the closure element 12 is removed, air can penetrate into the reservoir 3 via the dispensing orifice 50 so that the resilient element 4 can relax inside the reservoir and increase the inside volume thereof. The reservoir 3 is then filled with fluid and with gas (in general, air). To dispense fluid in the form of a spray, it is necessary merely to act on the wall 1 by means of the thumb, for example, against the action of the resilient element 4, so as to expel air through the fiber 6 imbibed with fluid. The air passing through the imbibed fiber 6 generates a two-phase spray at the dispensing orifice 50. As soon as the pressure on the actuating wall 1 is released, said actuating wall resumes its shape shown in FIG. 2, because of the resilient action of the element 4.

The resilient element 4 acts as a spacer in the storage state (FIG. 1) by determining a minimum volume for the reservoir 3, as a trigger for increasing the inside volume of the reservoir 3 when the closure element 12 is torn off, and as a return spring after the actuating wall 1 has been actuated by being pressed.

By way of example, the resilient element 4 may be in the form of a conical spiral spring as can be seen in FIGS. 1 and 2. The conical spiral spring offers the advantage of being capable of being compressed in a manner such as to bring all of its turns into the same plane, as can be seen in FIG. 1. The spring then has thickness corresponding to the thickness of a single turn. Between each turn, the spring 4 defines a volume inside which the fluid can be stored without it being subjected to any pressure from the outside. For example, the base of the conical spiral spring 4 may be placed in contact with the wall 2, so that the turn of smallest diameter comes into contact with the actuating wall 1, thereby making it easier for the wall 1 to distend convexly. This is a particularly simple design for the resilient element 4, making it possible to procure the advantages of the present invention.

Reference is made below to FIGS. 3 to 5*b* to present a variant for the resilient element 4. In this variant, the element is a part made entirely of a plastics material, e.g. by molding. Like the conical spiral spring of FIGS. 1 and 2, this plastics spring is capable of being compressed so as to bring all of its component parts into the same plane, as can be seen in FIG. 4*a*.

This resilient element 4 includes two resilient cross-braces 41 fixed via their ends to two bars 42 designed to rest against the sheet 1 of the dispenser. The resilient cross-braces 41 are capable of deforming resiliently outwards as can be seen in FIG. 4*b*. Respective hinged legs 43 are connected substantially to the middle of each cross-brace 41. The two hinged legs 43 are interconnected at their other ends via a small table-top 44. The two legs 43 are hinged relative both to the respective cross-braces 41 and to the table-top 44, so that the table-top 44 can be brought into the plane defined by the cross-braces 41 and by the bars 42 by the cross-braces deforming outwards as can be seen in FIGS. 4*a* and 4*b*. The top surface of the table-top 44 serves to come into contact with the actuating wall 1 of the dispenser. The non-stressed rest state of the resilient element 4 is shown in FIGS. 3, 5*a,* and 5*b* and it also corresponds to the molding state. Thus, so long as the reservoir is isolated from the outside, the resilient element 4 is in the shape shown in FIGS. 4*a* and 4*b,* i.e. completely flat. As soon as the closure element 12 is removed, the resilient element resumes its initial rest shape as shown in FIGS. 5*a* and 5*b*.

In the alternative embodiment shown in FIGS. 6*a* and 6*b,* there is no resilient element, and it is the actuating wall itself that provides this resilience or shape memory characteristic. When the reservoir is sealed, the actuating wall is pushed in to the maximum extent so that there is almost no fluid in the reservoir (FIG. 6*a*). On opening, air enters, and the actuating wall resumes its rest shape as shown in FIG. 6*b*.

In both embodiments, the spirit of the present invention lies in the use of resilient means that are stressed to a compressed state when the dispenser is sealed so as to impart a particularly flat configuration to the dispenser, and that can relax so as to increase the inside volume of the reservoir by means of gas entering via the dispensing orifice once said orifice is opened.

What is claimed is:

1. A dispenser for dispensing a fluid, said dispenser comprising:

a reservoir (3) containing said fluid and provided with at least one actuating wall (10) on which pressure is exerted to reduce the volume of the reservoir, said reservoir being provided with resilient means (4) suitable for increasing the volume of the reservoir;

a dispensing orifice (50) via which the fluid is dispensed as a mixture with a gas, so as to generate a two-phase spray; and a removable closure element (12) for closing the dispensing orifice (50), thereby isolating the reservoir from the outside;

said dispenser being characterized in that the resilient means is stressed so that the reservoir defines a minimum volume so long as the closure element (12) closes off the dispensing orifice.

2. A device according to claim 1, in which the resilient means are defined by the actuating wall which has shape memory enabling it to return to a rest state in which the reservoir defines a maximum volume.

3. A device according to claim 1, in which the resilient means comprise a resilient element disposed inside the reservoir.

4. A device according to claim 1, in which the resilient means includes a resilient element that acts on the actuating wall.

5. A device according to claim 1, in which the resilient means includes a resilient element that relaxes so as to increase the volume of the reservoir as soon as the closure element is removed, by gas entering via the dispensing orifice into the reservoir.

6. A device according to claim 1, in which the resilient means includes a resilient element that is in the form of a conical spiral spring (4) suitable for being flattened to the thickness of one turn.

7. A device according to claim 1, in which the resilient means includes a resilient element that is in the form of a molded plastics part (4) including resilient cross-braces (41) between which a hinged assembly (43, 44) extends that is suitable for being stressed into the same plane as the cross-braces.

8. A device according to claim 7, in which the assembly comprises two legs (43) each connected via one of its ends to a respective one of the resilient cross-braces (41), and via its other end to a small table-top, so that the table-top can be brought into the same plane as the cross-braces (41) and the legs (43).

9. A device according to any preceding claim, in which the reservoir substantially contains only fluid so long as the closure element closes off the dispensing orifice.

10. A dispenser for dispensing a fluid, said dispenser comprising:

a reservoir containing a fluid and having an actuating wall that flexes between a first position and a second position, wherein a volume of the dispenser in the first position is smaller than a volume of the dispenser in the second position;

a spring that biases the actuating wall towards the second position;

a dispensing orifice via which the fluid is dispensed as a mixture with a gas, so as to generate a two-phase spray; and a closure element that closes the dispensing orifice, thereby isolating the reservoir from the outside;

wherein, with the dispensing orifice closed by the closing element, the spring is stressed and the actuating wall is in the first position.

11. The dispenser according to claim 10, wherein the closure element is a frangible tab that is broken to open the dispensing orifice and release the spring.

12. The dispenser according to claim 10, wherein the spring is a spiral spring.

13. The dispenser according to claim 10, wherein the spring includes a resilient element of molded plastic, including resilient cross-braces between which a hinged assembly extends and that is configured to be stressed into the same plane as the cross-braces.

14. A dispenser for dispensing a fluid, said dispenser comprising:

a reservoir containing a fluid and having an actuating wall that flexes between a first position and a second position, wherein a volume of the dispenser in the first position is smaller than a volume of the dispenser in the second position, and wherein the actuating wall has a shape memory that biases the actuating wall towards the second position;

a dispensing orifice via which the fluid is dispensed as a mixture with a gas, so as to generate a two-phase spray; and a closure element that closes the dispensing orifice, thereby isolating the reservoir from the outside;

wherein, with the dispensing orifice closed by the closing element, the actuating wall is stressed against its bias into the first position.

15. The dispenser according to claim 14, wherein the closure element is a frangible tab that is broken to open the dispensing orifice and release the actuating wall.

* * * * *